US005551329A

United States Patent [19]

Iovane

[11] Patent Number: 5,551,329

[45] Date of Patent: Sep. 3, 1996

[54] STABLE TREMDO SYSTEM FOR STRINGED MUSICAL INSTRUMENTS AND RELATED ADJUSTMENT DEVICE

[76] Inventor: Antonio Iovane, Via Brescia N. 13, 80034 Marigliano, (NA), Italy

[21] Appl. No.: 358,146

[22] Filed: Dec. 15, 1994

[30] Foreign Application Priority Data

Dec. 21, 1993 [IT] Italy ..... NA93A0030

[51] Int. Cl.[6] ..... G10D 3/00

[52] U.S. Cl. ..... 84/313

[58] Field of Search ..... 84/313

[56] References Cited

U.S. PATENT DOCUMENTS 4,383,466 5/1983 Shibuya ..... 84/313

4,939,971 7/1990 Satoh ..... 84/313

*Primary Examiner*—Cassandra C. Spyrou

*Attorney, Agent, or Firm*—Michael J. Striker

[57] ABSTRACT

A tremolo-bridge for stringed instruments, in which the "bridge" and the "tailpiece" can rotate synchronously on one of two fulcrums according to a travel direction of a tremolo arm. Only one fulcrum at a time is involved during a rotation and the only points of friction during operation of the tremolo device are located at these fulcrums. The tremolo-bridge system advantageously includes a main block and a secondary block, each having its own rotation axis. One block has to work as both "bridge" and "tailpiece" and is pivotally mounted on the other block which, in turn, can be mounted on the instrument body. For best adjustment, two sets of countertension springs are provided (one for each block) as well as a differential adjusting device which changes the distribution of spring tension between the two sets of springs, and hence the two blocks, as well as the total spring tension. The main feature of the system is its adjustable range of stability, over which it is indifferent to the variations of the string pull (due to the fact that it doesn't work in a critical balance position).

9 Claims, 7 Drawing Sheets

STABLE TREMDO SYSTEM FOR STRINGED MUSICAL INSTRUMENTS AND RELATED ADJUSTMENT DEVICE

BACKGROUND OF THE INVENTION

The present invention relates to a tremolo system for stringed musical instruments, particularly guitars, and to a related adjustment device for the tremolo system.

The tremolo effect consists of a pitch variation of the notes produced by the instrument. As an example hereinbelow, the tremolo system for a solid body electric guitar is described. By "guitar body" is meant the body of the guitar itself, or any structure rigidly attached to it. Furthermore the term "fulcrum" is used to designate the support points of rotation axes in the guitar structure.

A known tremolo system or device comprises a unique block which supports the saddles over which the strings pass, the anchor points of the strings and a control arm for the tremolo device. The entire block is "floating" on a single fulcrum in a balance position which results from an equilibrium between tension of the strings and the spring action of one or more countertension springs. The fulcrum usually is formed by two or more screws or pivots fixed to the guitar body.

The prior art tremolo system has the following problems:—the tension variation of a string, for example, during the tuning phase, alters the balance and affects the other strings inversely;—some musical techniques of playing the guitar with the prior art tremolo system produce "out of tune" notes;—part of the force applied to the strings (by the player) to make them vibrate is wasted on the springs;—the transmission of the vibrations to the guitar body is reduced by the fact that the system is "floating" and has a mechanical coupling with the instrument entrusted only to the fulcrum; the total resonance, the timbre characteristics and the sound sustained are penalized.

Some prior art systems have attempted to overcome some of these problems, but they have introduced other problems such as increased complexity, set up difficulties, instability, a worsening of acoustics as a trade off for a gain in the stability, and vice versa.

Some systems need a specific block action during use. Others, when operated in the ascending direction, pull the strings, making them slide over the saddles; because of this, friction and noise result, and they damp a part of the vibrating string, with a loss of sustained sound and harmonics. Furthermore, because of their nature, these systems cannot be equipped with locking saddles (that is having the anchor point of the string), or with any kind of fine tuning mechanism. In the following is described a system which overcomes these problems without important collateral inconveniences.

SUMMARY OF THE INVENTION

It is an object of the present invention to provide a tremolo system for a string instrument which avoids the disadvantages of the prior art tremolo systems.

According to the invention the tremolo-bridge system for a stringed instrument provided with an instrument body and strings comprises saddles ("bridge") for the strings, the saddles being rotatable about each of two rotation axes; a tremolo arm and means for rotating the saddles about a selected rotation axis according to a selected travel direction of the tremolo arm.

Advantageously the tremolo-bridge system also includes a main block and a secondary block interacting with the main block. Each block has its own rotation axis. At least one set of countertension springs provides a countertension for the pull of the strings. The secondary block advantageously includes the saddles and means for securing or anchoring the strings.

This system has good stability features, tune keeping ability and provides means for return to a rest position. A related adjustment device allows the adjustment of the working softness to achieve the desired values.

In a preferred embodiment of the invention an additional set of countertension springs are connected to the secondary block to provide additional countertension for the pull of the strings. The main block is provided with fulcrums and stop means for the secondary block and the secondary block is pivotally mounted on the fulcrums of the main block so that the saddles can be rotated about the other rotation axis without moving the main block by pivoting the secondary block in one direction with the tremolo arm or the saddles can be rotated together with the main block about the one rotation axis by pivoting the secondary block in another direction with the tremolo arm.

In the preferred embodiment stop means for the main block are provided on the instrument body so that the main block is in a rest position when the main block contacts the stop means on the instrument body and means for holding the main block on the stop means on the instrument body despite variations in string tension due to combined action of the springs and strings are provided.

The tremolo-bridge system also can include a differential adjustment mechanism comprising a retaining plate and at least one total tension adjusting screw securing the retaining plate to the instrument body to control a total tension in the countertension springs according to an extent to which the at least one total tension adjusting screw is screwed into the instrument body; a tension distributing screw extending from the retaining plate and having two oppositely-threaded sections; a first spring plate screwed onto one of the oppositely threaded sections and a second spring plate screwed onto another of the oppositely threaded sections, the one set of the countertension springs being hooked to the first spring plate and the other set of the countertension springs being hooked to the second spring plate so that, when the distributing screw is turned, the spring plates move in opposite directions to distribute the total spring tension between the sets of the springs differently while keeping the total spring tension substantially unchanged.

The tremolo system according to the invention is not a floating type, and advantageously comprises two separate blocks which turn on different fulcrums. Such fulcrums can, in the extreme, be coaxial. These two blocks are designated the "main block" and "secondary block" even if they have functions which are of the same importance.

BRIEF DESCRIPTION OF THE DRAWING

The objects, features and advantages of the present invention will now be illustrated in more detail by the following detailed description, reference being made to the accompanying drawing in which.

DESCRIPTION OF THE PREFERRED EMBODIMENTS

Figure 1:
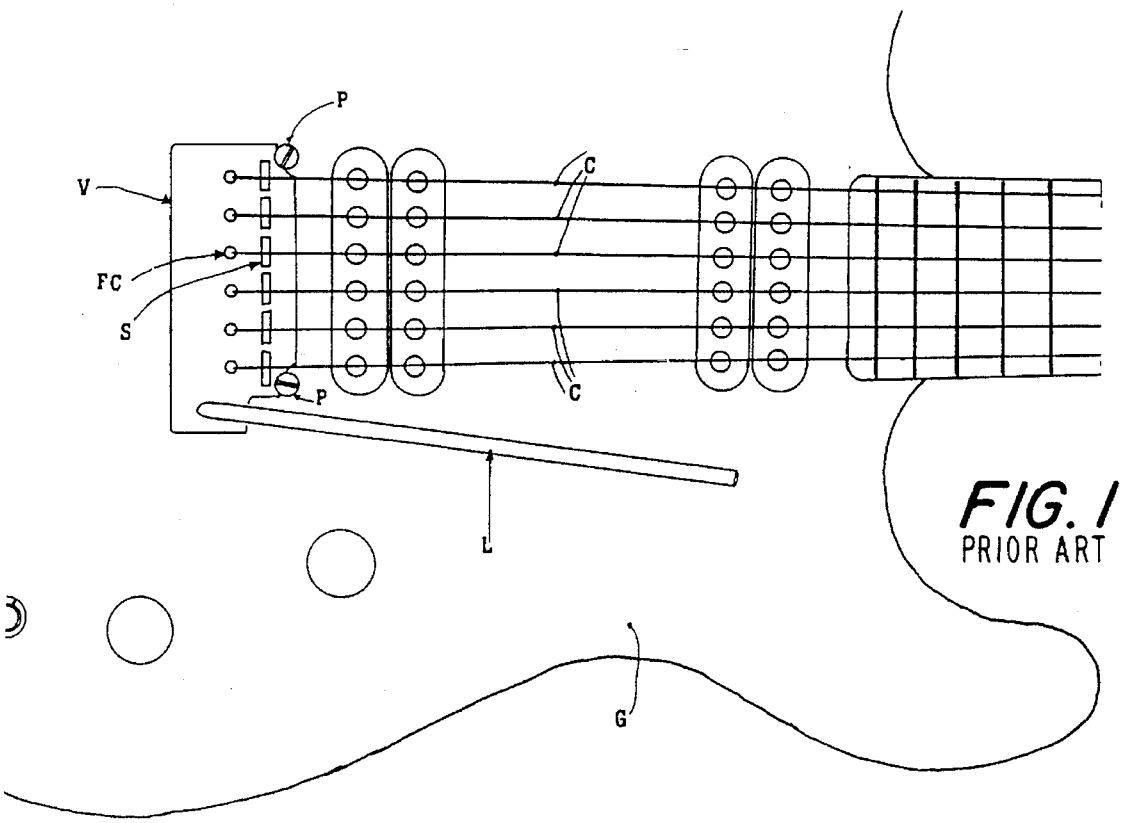
FIG. 1 PRIOR ART
FIG. 1 is a plan view of a solid body electric guitar with a tremolo system of the prior art.
Figure 2:
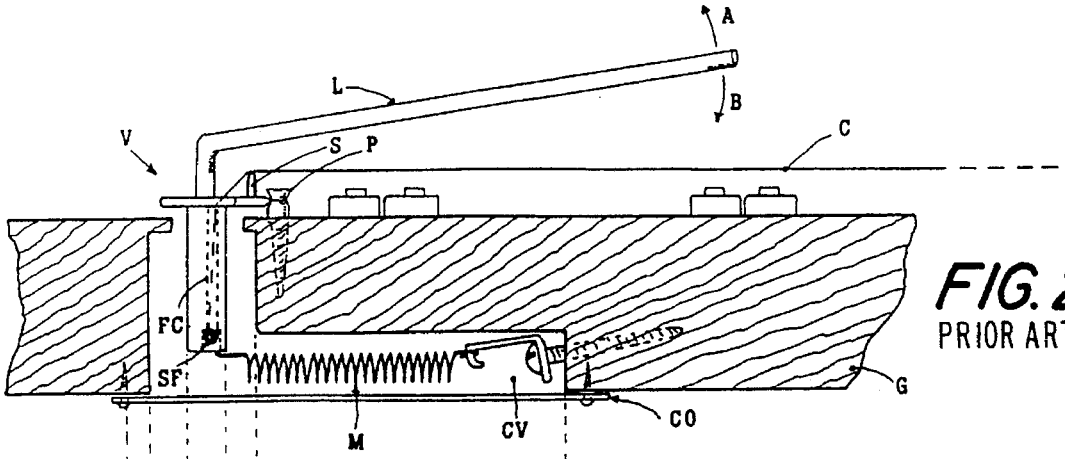
FIG. 2 PRIOR ART
FIG. 2 is a cutaway cross-sectional view through the solid body electric guitar and tremolo system shown in FIG. 1.
Figure 3:
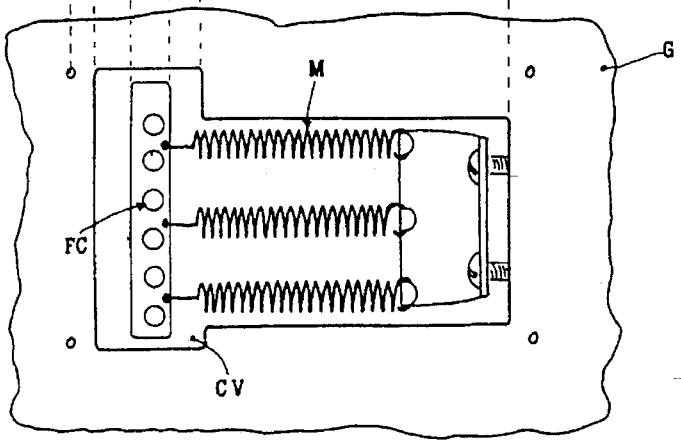
FIG. 3 PRIOR ART
FIG. 3 is bottom plan view of the tremolo system shown in FIGS. 1 and 2.
Figure 4:
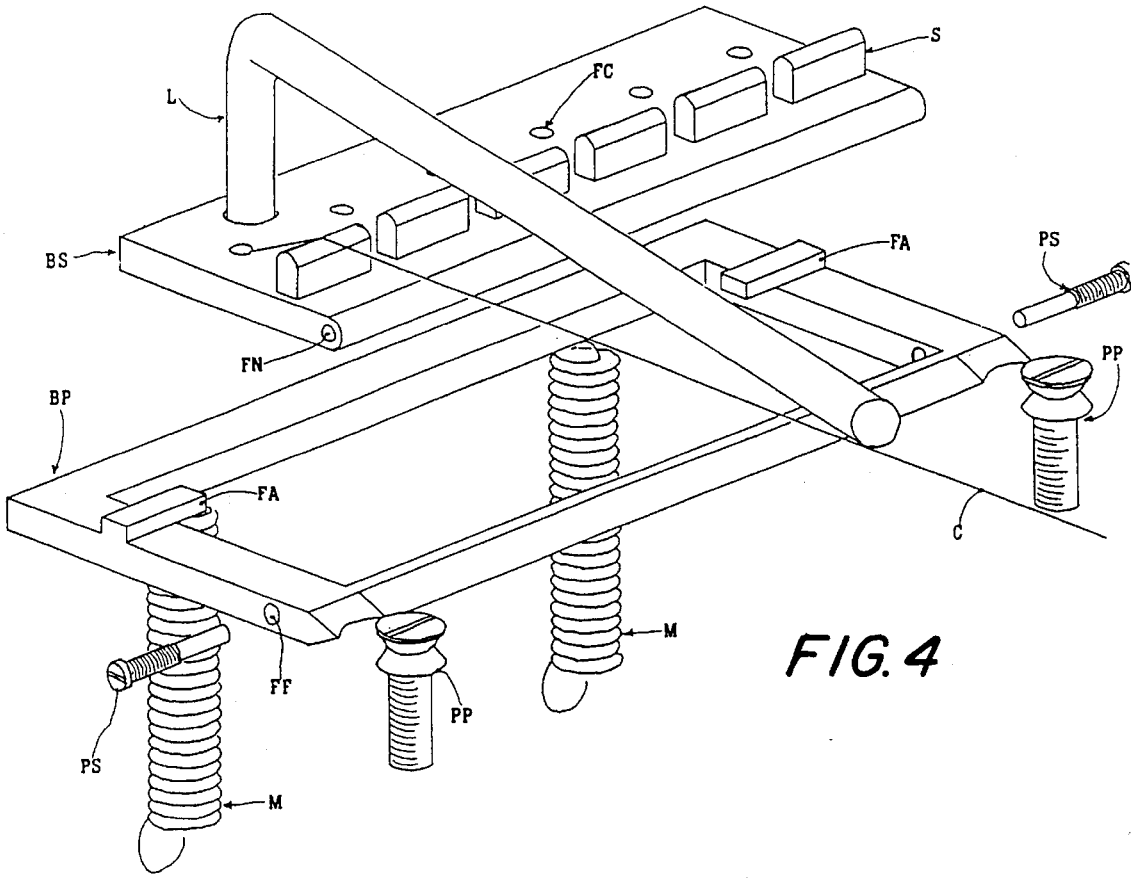
FIG. 4 is an exploded perspective view of a tremolo system according to the invention, illustrating the basic operating principles of the tremolo system.
Figure 5:
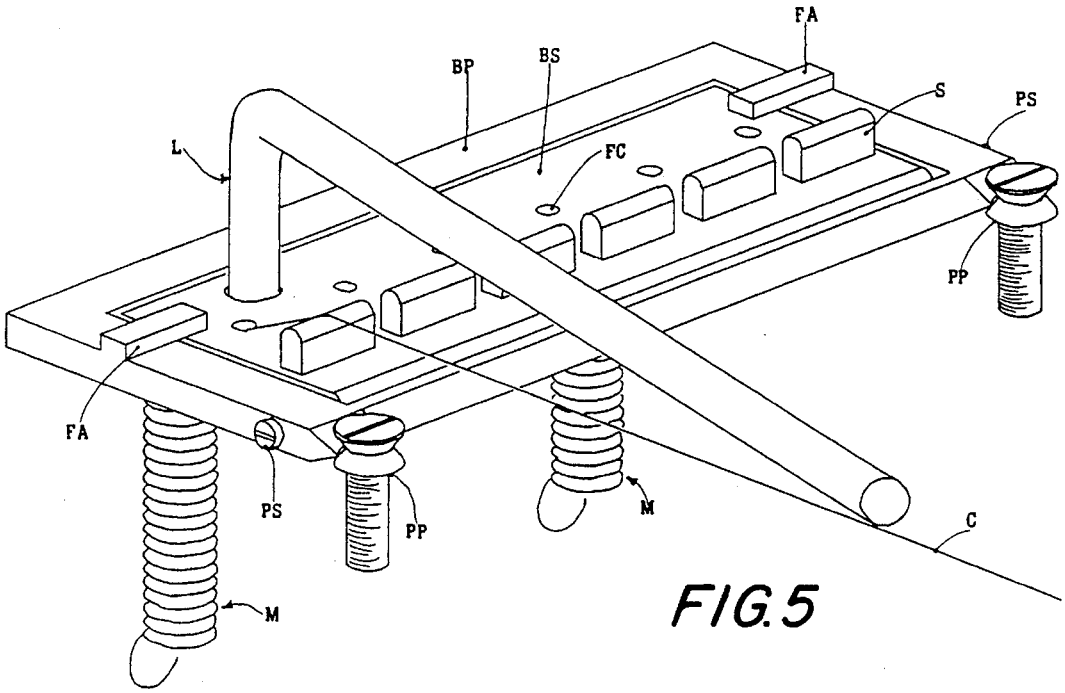
FIG. 5 is a perspective view of the tremolo system of FIG. 4.

The prior art tremolo system or device comprises a unique block V which supports the saddles S over which the strings C pass, the anchor points of the strings, the tremolo arm L and optionally additional devices which are not described here. The entire block V is "floating" on a fulcrum in a balance position which results from the balance between the tension of the strings C and that of one or more countertension springs M. The fulcrum usually comprises two or more screws or pivots P fixed to the guitar body G. The block V is provided with throughholes FC through which the strings C pass. The other parts shown do not concern the tremolo. FIG. 2 is a side cross-sectional view which provides an elevational view of the device showing how the device is "floating". Each string has an ending ball SF, which is part of the means for anchoring the string, at its end which is held in the block V. The countertension springs M are connected to the block V as shown in FIG. 3. The countertension springs M and block V are accommodated in the cavity CV in the guitar body G. A cover plate CO is provided which covers the cavity CV. The throughholes FC pass vertically through the block V, and are provided with an enlarged terminal lower section having a comparatively larger diameter to receive the ending balls SF of the strings C (see FC in FIGS. 1, 2 and 3). This type of tremolo system of the prior art is driven by a force applied by the hand to the tremolo arm L. The force alters the balance and changes the strings' tension with subsequent variation of the produced notes. The force can be applied in two directions (see FIG. 2): direction B, the descending direction, which loosens the strings' tension and gives flat notes; direction A, the ascending direction, which increases the strings' tension and gives sharp notes.

FIGS. 4 to 8 show an illustrative embodiment of the tremolo system of the invention, which is designed to illustrate the principles of the invention. The main block BP pivots on a fulcrum and cannot be moved past the rest position shown in FIGS. 6 and 8 into the guitar body G. This fulcrum, pivot posts PP, is secured to the guitar body G. Main block BP does not support the saddles S for the strings C, or any anchor points for the strings C, nor the mounting point of the tremolo arm L. It is kept normally in a flat position resting on stop means AP1 included in the guitar body G by convenient countertension springs M (see FIG. 6). By "flat or rest" position is meant that position reached by a maximum possible rotation of main block BP towards the direction A until it contacts stop means AP1 which comprises an adjacent portion of the guitar body G. This position (FIG. 6) is the rest position of the main block BP. From this position, it can rotate only in descending direction B ( FIG. 7).

The secondary block BS operates simultaneously as "bridge" (saddles) and "tailpiece" (strings' anchorage). It turns on a fulcrum which is advantageously placed on the main block BP.

In this example (FIG. 4) the fulcrum comprises pivots PS, which have a threaded part that screws into the threaded holes FF in the main block BP, and a nonthreaded part that enters into the holes FN of the secondary block. This secondary block BS (see FIG. 4) supports the saddles S for the strings C, the anchor points for them (in throughholes FC), and additional mechanisms (not described here), and the mounting point of the control or tremolo arm L. It should be noted that the saddles S are nonrotatably fixed to the secondary block BS having the anchor points for the strings C and the tremolo arm L. This can allow the use of locking saddles, which lock the strings C, and, in this embodiment, a separate tailpiece section may be redundant and so eliminated (depending on the type of locking saddles). The strings' tension, applied to the secondary block BS through the saddles S and the anchor points, tends to make it rotate in the descending direction B, while the main block BP remains in the rest position because of the springs. One or more stops, placed on the main block, stop the rotation of the secondary block in its rest position (in FIGS. from 4 to 8 the stops are the elements FA). The secondary block can rotate by itself on its own fulcrum PS towards the A direction (ascending—FIG. 8), and towards the B direction (descending—FIG. 7) along with the main block around the relative fulcrum (PP). We notice that the tremolo arm is applied to the secondary block.

Figure 6:
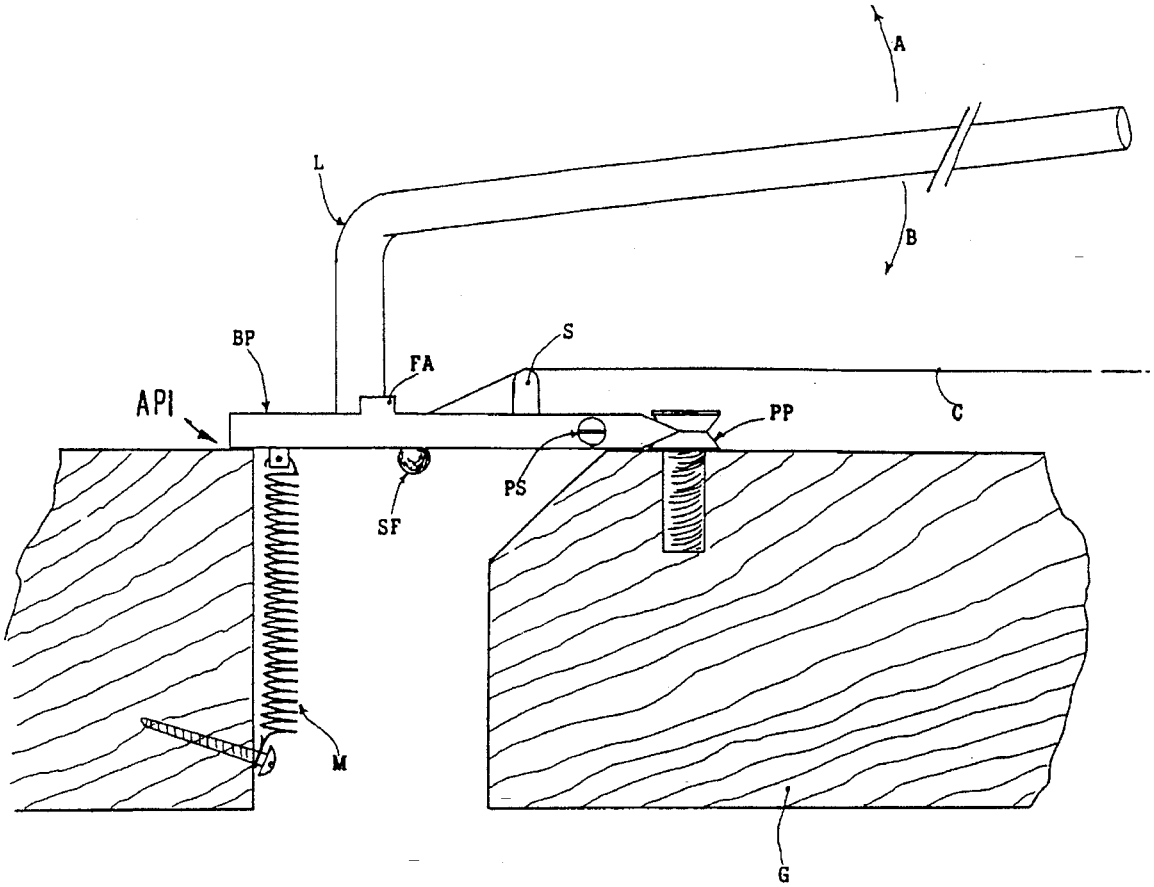
FIG. 6 is side action view of the tremolo system of FIG. 5.
Figure 7:
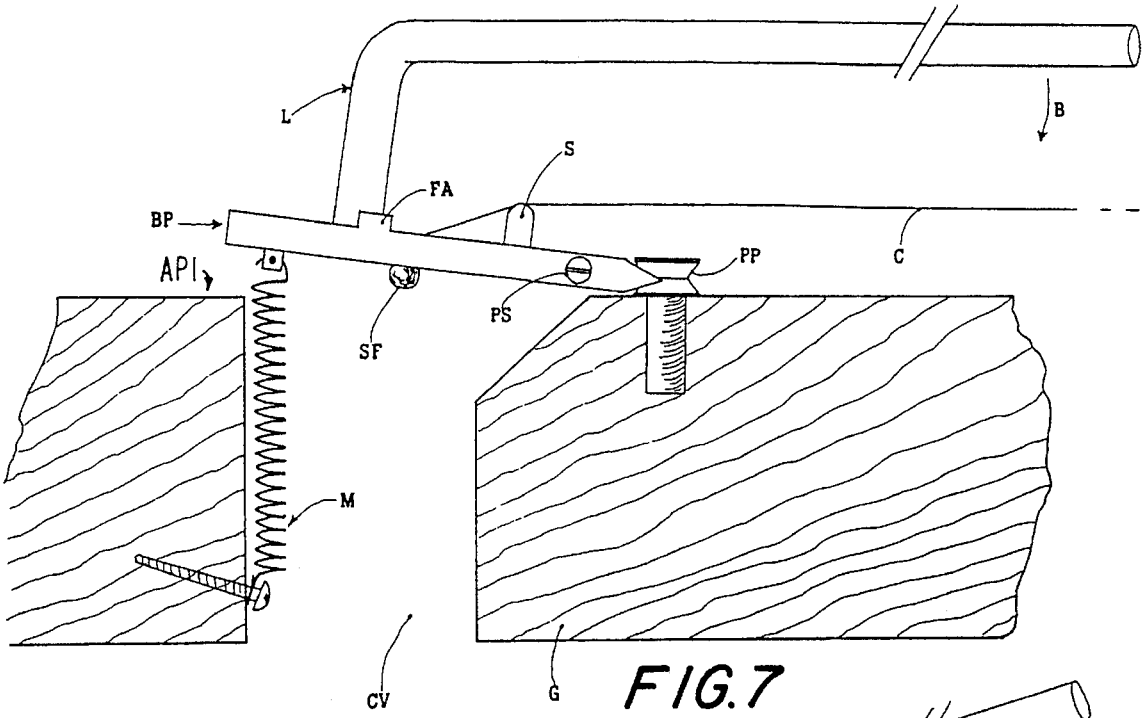
FIG. 7 is another side action view of the tremolo system of FIG. 5.
Figure 8:
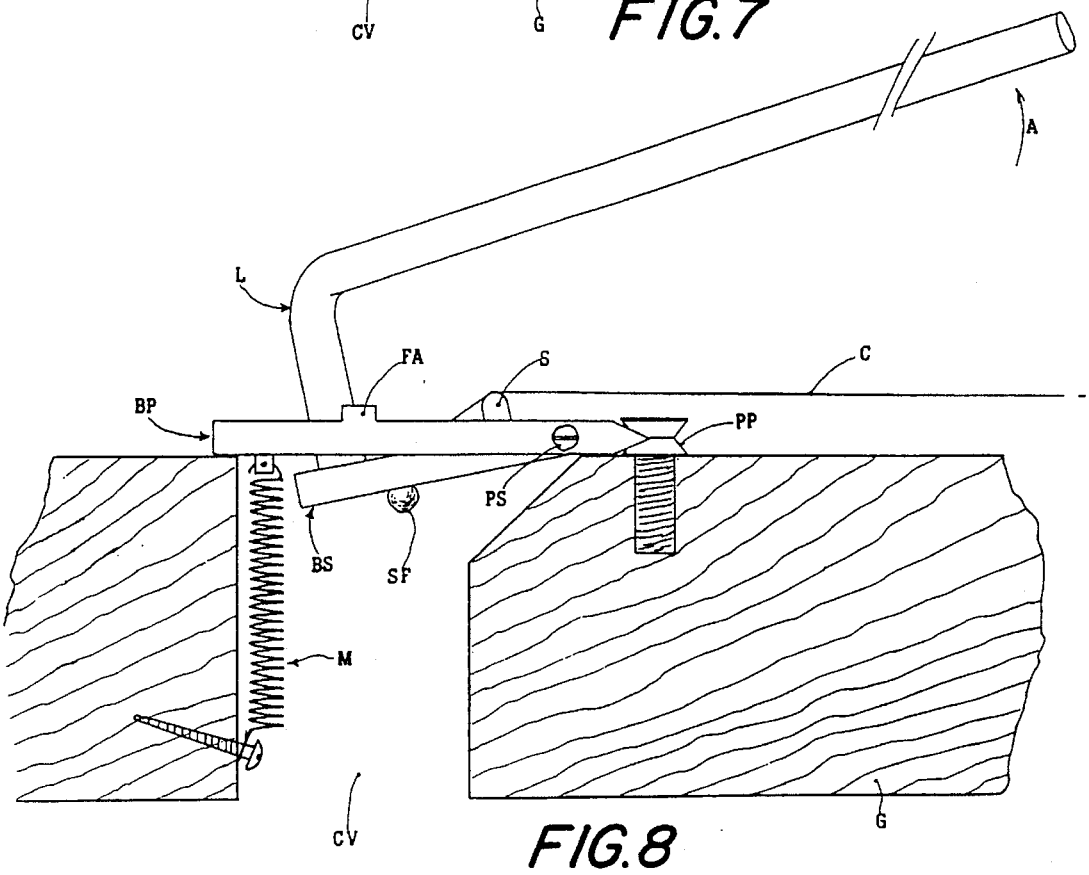
FIG. 8 is an additional side action view of the tremolo system of FIG. 5.

The entire tremolo system is in the rest position when both the blocks are in the rest position; that is when the main block BP contacts the guitar body G, due to the spring tension, and the secondary block BS is arrested by the stops FA on the main block, due to the pull of the strings (FIG. 6). When the arm is driven towards the B direction (descending) both the blocks move; when it is driven toward the A direction (ascending) only the secondary block moves. When the control arm L is released, however, the system comes back to the rest position. The pulling force of the countertension springs M must be greater than the minimum one necessary to keep the main block in contact with the guitar body G when the strings C are in tune. How much greater that pulling force should be is a matter of choice, which depends on the stability range of the system and its handiness.

The concept of stability range of the force on the guitar body is well defined. If T1 is the total tractive force of the strings, a force T2>T1 exists at which the main block BP detaches from the guitar body. The difference T2–T1 represents the stability range for the force acting on the main block.

The following should be noted:—in the absence of the strings, the secondary block is free to move;—if a string (or more than one) breaks, the entire tremolo system does not move;—if playing techniques as "bending" are used (shifting of the strings using the fingers on the guitar fretboard), the entire tremolo system does not move, within the stability range;—there is a better transmission of sound to the guitar body, because the system is not floating, even if it can be operated either in descending or ascending direction; and—there is no wasting of the force applied to the strings to make them vibrate;—there is no friction except at the fulcrums;—also only one fulcrum at a time is used during operation; and finally—the tuning is simplified.

Having illustrated the basic operating principle of the tremolo system of the invention, a preferred embodiment of the invention is now described including a differential adjustment mechanism which is described in more detail hereinbelow.

Although the embodiment of the tremolo device, as described above, does work, during testing of prototypes a certain resistance or hardness for motion in the B direction (ascending) has been noticed. This is because the force resisting that motion is the sum of all of the strings' tension. Towards the A direction (descending), instead, the required force can be set by springs' adjustment, even with some effect on the stability range.

Considering that the tension of tuned strings is constant, and the tractive force of the countertension springs could be selected by the designer, it was decided to make the proportionate share of this force borne by each of the two blocks adjustable in a differential way to facilitate the driving towards the direction A (ascending). Unlike the embodiment described above two sets of springs are required: one anchored to the main block and the other to the secondary block. For reasons of compatibility with the currently used systems, the embodiment of FIG. 9 and following figures was devised which accomplishes this.

Figure 9:
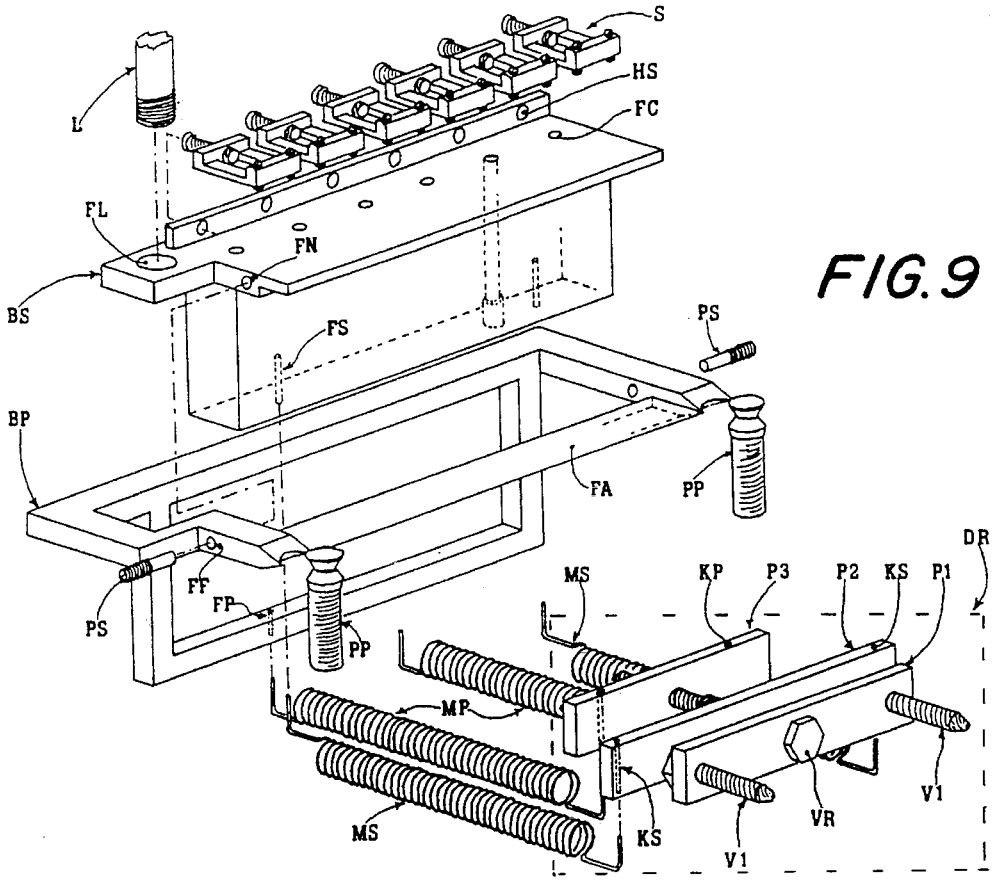
FIG. 9 is an exploded perspective view of a preferred embodiment of a tremolo system according to the invention, illustrating the basic operating principles of the tremolo system.
Figure 10:
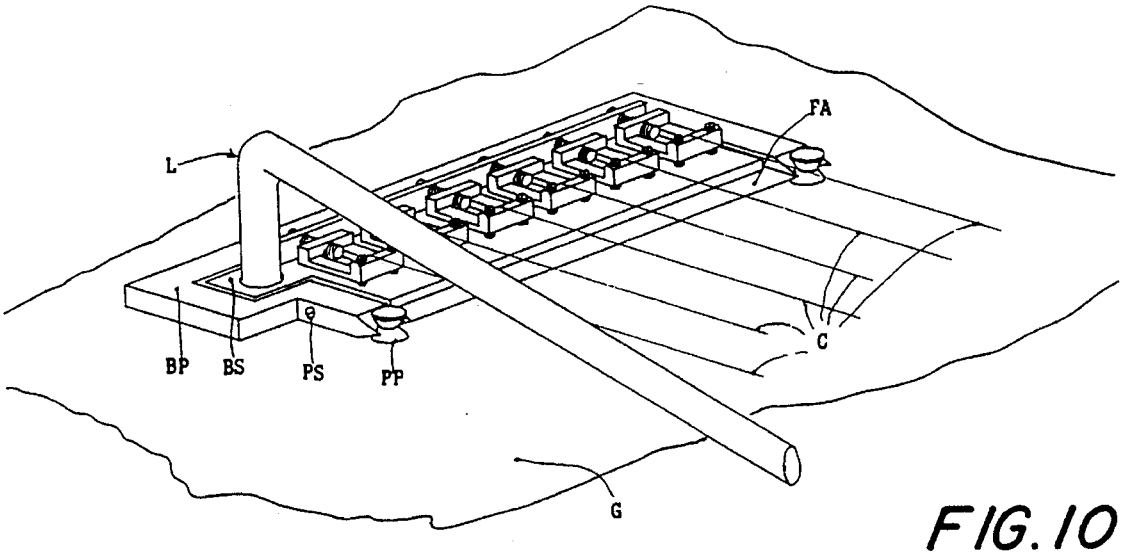
FIG. 10 is a perspective view of the preferred embodiment of the tremolo system of FIG. 9.

This preferred embodiment is shown in perspective in FIG. 9. The saddles S are of a standard type. They have to be mounted in the holes HS on the secondary block BS. The tremolo arm L also is of a standard variety. It has to be mounted in the hole FL in the secondary block BS. The secondary block BS comprises a unique block of metal or such parts joined together. The secondary block BS is provided with holes HS for saddles' mounting, the threaded hole FL for tremolo arm mounting, the throughholes FC through which the strings pass, the nonthreaded holes FN for the pivots PS which comprise the fulcrum for the secondary block BS, and in the lower part the two holes FS for hooking the ends of two countertension springs MS.

Figure 12:
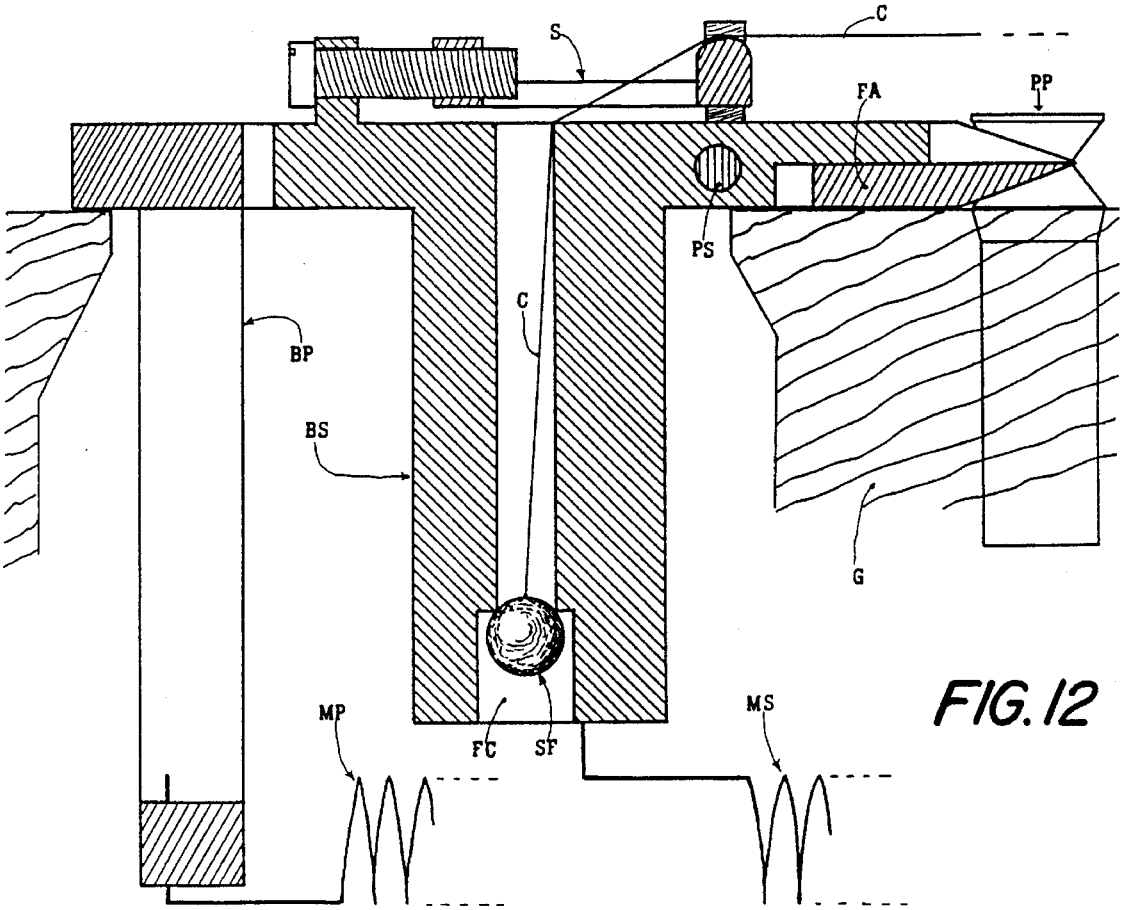
FIG. 12 is a detailed view of the tremolo device shown in FIG. 11 taken through a through hole closest to the tremolo arm.

The main block BP comprises a unique block of metal or parts joined together. It has two knife-edge shaped notches, which are shaped to rest on the pivot posts PP, which comprise the fulcrum for the main block BP. The bar FA constitutes a stop means for the secondary block (see also the FIG. 12). The pivots PS are screwed or secured in the threaded holes FF through the main block BP. A lower part of main block BP has two holes FP for hooking two countertension springs MP. The two pivot posts PP of the fulcrum for the main block must be fixed (screwed) to the guitar body G.

Figure 14:
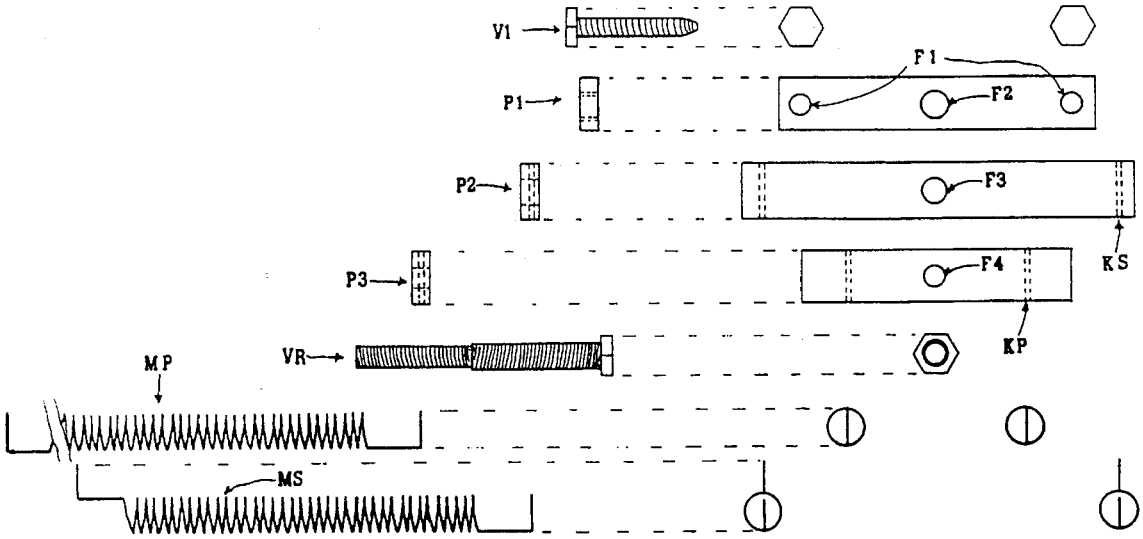
FIG. 14 is a plan view showing parts of a differential adjustment device of the tremolo system of FIG. 13.

The differential adjustment device DR comprises the parts shown in FIG. 14, where even the countertension springs MS and MP are shown again.

Figure 11:
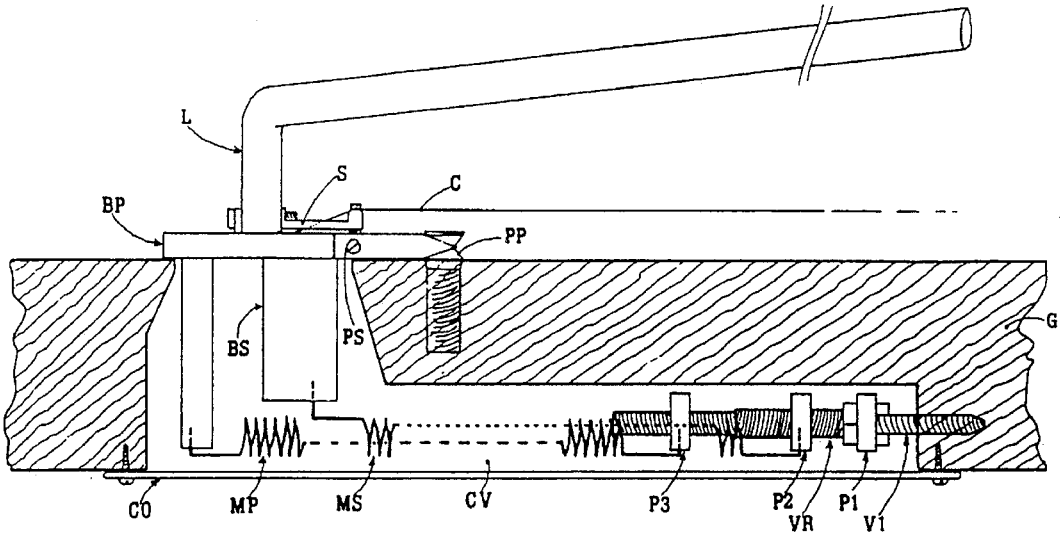
FIG. 11 is a side view of the tremolo system shown in FIG. 9 in a rest position.

The differential adjustment device DR is seen assembled in FIGS. 11 (side) and 13 (bottom), and in perspective view in FIG. 9. As shown particularly in FIGS. 13 and 14 it comprises a tension distributing screw VR having a larger diameter section and a smaller diameter section at its free end and total tension adjusting screws V1 which are screwed into in the guitar body G; retaining plate P1 which is secured to the guitar body by tension adjusting screws V1 which pass through two nonthreaded throughholes F1 in the plate P1, which plate P1 being provided with a nonthreaded throughhole F2 for the screw VR; second spring plate P2 which is provided with two holes KS for hooking of the ends of countertension springs MS and a central hole F3 with left-handed thread for engaging the section of the tension distributing screw VR having larger diameter; first spring plate P3 which is provided with two holes KP for the hooking of the ends of the countertension springs MP and a hole F4 provided with a right-handed thread for the section of the tension distributing screw VR having the smaller diameter. The section of the screw VR having the larger diameter has left-handed thread, and that having the smaller diameter has right-handed threads (or vice versa, if the threads of the holes F3 and F4 are inverted).

Figure 13:
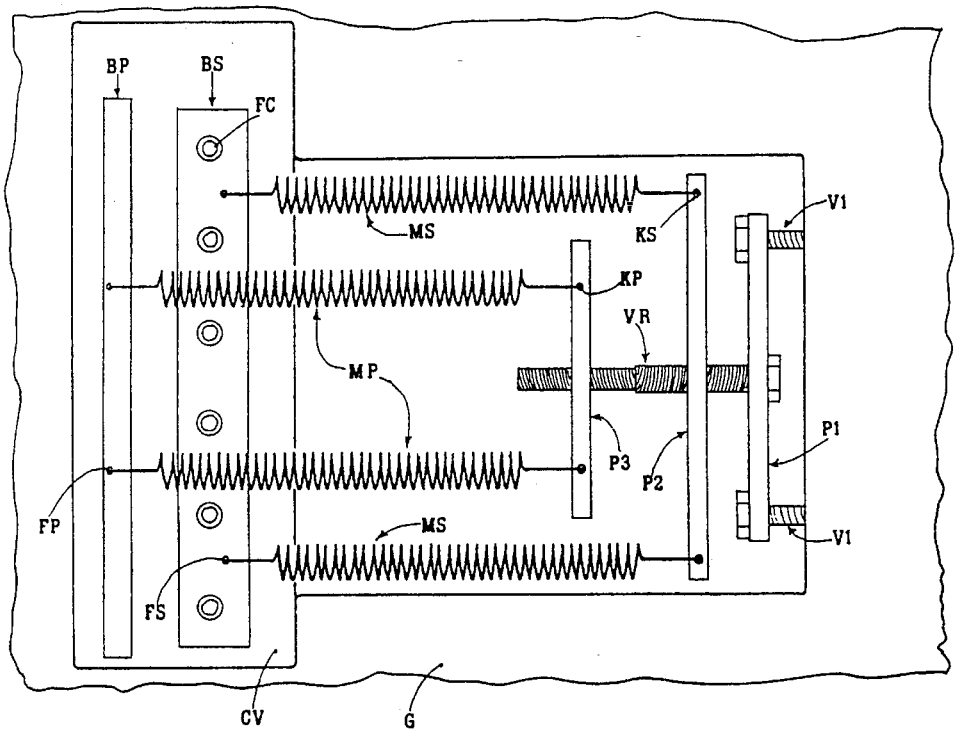
FIG. 13 is a bottom plan view of a differential adjustment device in the tremolo system of FIG. 12.

The countertension springs MP are hooked to the main block BP and to the first spring plate P3. The countertension springs MS must be hooked to the secondary block and to the second spring plate P2. The total tension of the countertension springs depends on how much the total tension adjusting screws V1 are screwed into the guitar body G (FIGS. 11 and 13).

By turning the tension distributing screw VR, the spring plates P2 and P3 shift in opposite directions, adjusting in a differential way the distribution of the total traction forces on the two blocks BP and BS (within a particular satisfying utilization range). The length of the screws V1 and VR, the pitch of the threads of VR, the length, the number and the springiness of the springs and the anchor points must be chosen for structural factors.

In the previously described embodiment of FIGS. 4 to 8, the minimum number of springs connected to the main block is 1 (one), and to the secondary block is 0 (zero). The embodiment including the additional springs and the differential adjustment device DR is an optimization or preferred embodiment of the invention. It is possible to adjust the system so that it works in a "floating" manner. Other embodiments are however possible. The minimum number of springs for each block is zero, but at least one block must have at least one spring. For example, in some embodiments only one set of springs is connected to the secondary block and no springs are connected to the main block.

For structural factors and for the desired range of the tremolo effect, instead, the shapes of the two blocks and the two rotation axes (fulcrums) have to be chosen. In particular, embodiments are possible having one or both the rotation axes inside the guitar body. There are many different possible embodiments.

A proper arrangement of the rotation axes (see FIGS. from 9 to 12) gives the system another important feature: the minimum distance between the strings and the instrument fretboard corresponds to that of the rest position. This is important when transducers are required that must be mounted as close to the strings as much as possible, such as transducers for "MIDI" converters.

While the invention has been illustrated and described as embodied in a tremolo system for stringed musical instruments, particularly guitars, it is not intended to be limited to the details shown in the examples, since various modifications and compositional changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is desired to be protected by Letters Patent is set forth in the appended claims.

What is claimed is:

1. Tremolo-bridge system for a stringed instrument including an instrument body and strings, said tremolo-bridge system comprising saddles for said strings, said saddles being rotatable about each of two rotation axes; a tremolo arm and means for rotating said saddles about a selected one of the two rotation axes according to a selected travel direction of the tremolo arm.

2. Tremolo-bridge system as defined in claim 1, wherein said means for rotating said saddles comprises a main block and a secondary block interacting with the main block, said main block being rotatable about one of said two rotation axes and said secondary block being rotatable about another of said two rotation axes and one set of countertension springs connected to said main block to provide a countertension for a pull of said strings and another set of said countertension springs connected to said secondary block to provide further countertension for said pull of said strings.

3. Tremolo-bridge system as defined in claim 2, wherein said secondary block is provided with said saddles and has means for anchoring said strings.

4. Tremolo-bridge system as defined 3, wherein said main block is provided with fulcrums and stop means for said secondary block and said secondary block is pivotally mounted on said fulcrums of said main block so that said saddles can be rotated about said another of said rotation axes without moving said main block by pivoting said secondary block in one direction with said tremolo arm or said saddles can be rotated together with said main block about said one of said rotation axes by pivoting said secondary block in another direction with said tremolo arm.

5. Tremolo-bridge system as defined in claim 4, further comprising stop means for said main block formed so that said main block is in a rest position when said main block contacts said stop means and means for holding said main block on said stop means despite variations in string tension due to combined action of said springs and strings, said stop means including a portion of said instrument body adjacent to said main block.

6. Tremolo-bridge system as defined in claim 2, further comprising a differential adjustment mechanism including a retaining plate and at least one total tension adjusting screw securing said retaining plate to said instrument body to control a total tension in said springs according to an extent to which said at least one total tension adjusting screw is screwed into said instrument body; a tension distributing screw engaged with and extending from said retaining plate and having two oppositely-threaded sections; a first spring plate screwed onto one of said oppositely threaded sections and a second spring plate screwed onto another of said oppositely threaded sections, said one set of said countertension springs being hooked to said first spring plate and said another set of said countertension springs being hooked to said second spring plate so that, when said distributing screw is turned, said spring plates move in opposite directions to distribute said total spring tension between said sets of said springs differently while keeping said total spring tension substantially unchanged.

7. Tremolo-bridge system as defined in claim 6, wherein said at least one tension adjusting screw includes two standard screws, said two standard screws being located at respective opposite ends of said retaining plate.

8. Tremolo-bridge system as defined in claim 1, wherein said means for rotating said saddles comprises a main block and a secondary block provided with said saddle and interacting with the main block, said main block being rotatable about one of said two rotation axes and said secondary block being rotatable about another of said two rotation axes and a set of countertension springs connecting said main block to said instrument body to provide a countertension to said springs.

9. Tremolo-bridge system as defined in claim 8, further comprising respective fulcrums for said main block and said secondary block, said main block and said secondary block being rotatably mounted on said respective fulcrums so that during rotation of said main block and said secondary block friction only occurs at one of said fulcrums in operation.

* * * * *